US007566141B2

(12) United States Patent
Kah, Jr.

(10) Patent No.: US 7,566,141 B2
(45) Date of Patent: Jul. 28, 2009

(54) CASSEGRAIN OPTICAL CONFIGURATION TO EXPAND HIGH INTENSITY LED FLASHLIGHT TO LARGER DIAMETER LOWER INTENSITY BEAM

(75) Inventor: Carl L. C. Kah, Jr., North Palm Beach, FL (US)

(73) Assignee: K-Rain Manufacturing Corporation, Riviera Beach, FL (US)

( * ) Notice: Subject to any disclaimer, the term of this patent is extended or adjusted under 35 U.S.C. 154(b) by 0 days.

(21) Appl. No.: 11/438,618

(22) Filed: May 22, 2006

(65) Prior Publication Data

US 2006/0262524 A1 Nov. 23, 2006

Related U.S. Application Data

(60) Provisional application No. 60/683,043, filed on May 20, 2005.

(51) Int. Cl.
*F21L 4/00* (2006.01)

(52) U.S. Cl. ..... 362/201; 362/191

(58) Field of Classification Search ..... 362/300, 362/191

See application file for complete search history.

(56) References Cited

U.S. PATENT DOCUMENTS 3,539,798 A * 11/1970 Perry ..... 362/308
4,075,471 A * 2/1978 Jones ..... 362/300
6,796,698 B2 * 9/2004 Sommers et al. ..... 362/555
6,893,140 B2 * 5/2005 Storey et al. ..... 362/191
7,033,061 B1 * 4/2006 Wu ..... 362/607
7,066,622 B2 * 6/2006 Alessio ..... 362/187
7,083,297 B2 * 8/2006 Matthews et al. ..... 362/184
7,181,378 B2 * 2/2007 Benitez et al. ..... 703/2
2004/0036975 A1 2/2004 Slatkine ..... 359/584

FOREIGN PATENT DOCUMENTS

EP 1 213 773 A1 6/2002

OTHER PUBLICATIONS

International Search Report dated Feb. 22, 2007.

* cited by examiner

*Primary Examiner*—Anabel M Ton
(74) *Attorney, Agent, or Firm*—Ostrolenk, Faber, Gerb & Soffen, LLP

(57) ABSTRACT

A flashlight in accordance with an embodiment of the present application includes an LED light source, a lens positioned opposite the LED light source, a convex mirror positioned substantially in a center of the inner surface of the lens, wherein light from the LED light source is reflected off the convex mirror back toward the LED light source and a concave mirror positioned opposite the convex mirror to reflect the light from the convex mirror as a wide diameter beam of light out of the flashlight through the lens. The convex mirror maybe replaced by a substantially flat, mirrored section of the lens if desired.

14 Claims, 2 Drawing Sheets

Cassegrain Optical Configuration to Expand High Intensity LED Flashlight to Larger Diameter Lower Intensity Beam

Cassegrain Optical Configuration to Expand High Intensity LED Flashlight to Larger Diameter Lower Intensity Beam Cassegrain Optical Configuration to Expand High Intensity LED Flashlight to Larger Diameter Lower Intensity Beam

CASSEGRAIN OPTICAL CONFIGURATION TO EXPAND HIGH INTENSITY LED FLASHLIGHT TO LARGER DIAMETER LOWER INTENSITY BEAM

CROSS-REFERENCE TO RELATED APPLICATION

This application claims the benefit of the priority of Provisional Application No. 60/683,043 filed May 20, 2005, the contents of which are specifically incorporated by reference herein.

BACKGROUND

LED flashlights have many advantages, including long life expectancy of the LED light source, and low current drain. However, with current LEDs, the beam size that they produce requires use of more than one LED when larger diameter flashlight beams are desired.

Cassegrain optics used in a two-mirror telescope can be traced to the mid 1600s. Though no successful telescopes were produced during this time, the idea was first conceived then and is now the most prominent type of large-scale telescope in production. The idea of the Cassegrain telescope is to fold incoming light using two mirrors and achieve long focal lengths with relatively little weight or size (as compared to the Newtonian-type telescope).

Light enters through the lens and is reflected off a spherical or parabolic primary mirror and is refracted onto a convex hyperbolic secondary mirror. In the specific application for use in a telescope, the focal length is adjusted to correctly display the image at the calculated position of the eyepiece which is typically slightly behind perforations in the primary mirror.

The present application proposes the use of Cassegrain optics in reverse, i.e., not to collect light and concentrate it, but to receive a narrow beam of high intensity light from an LED light source and expand its diameter to a larger size and lower intensity. This avoids the need for multiple LEDs to create a large diameter beam.

SUMMARY OF INVENTION

Figure 1:
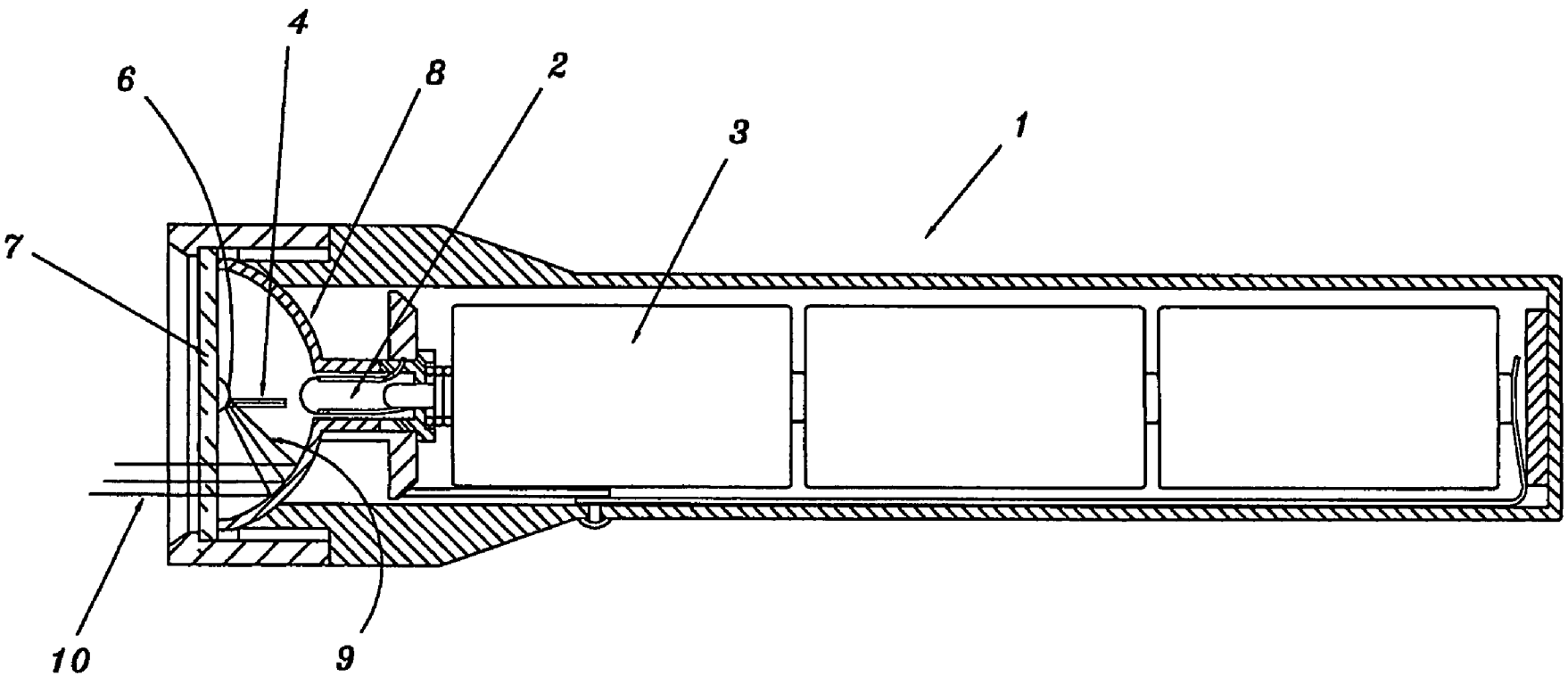
FIG. 1 shows a cross section of an LED flashlight using Cassegrain optics to expand the light output from a high intensity LED light source in accordance with an embodiment of the present application.

It is an object of the present application to use Cassegrain optics in reverse to generate light over a wide area from a single LED's narrow beam. The beam is preferably directed at a secondary (convex hyperbolic) mirror which reflects the light back on to a parabolic primary mirror. From here, the light path is directed out the front of the flashlight lens in a flood beam.

A flashlight in accordance with an embodiment of the present application includes an LED light source, a lens positioned opposite the LED light source, a convex mirror positioned substantially in a center of the inner surface of the lens, wherein light from the LED light source is reflected off the convex mirror back toward the LED light source and a concave mirror positioned opposite the convex mirror to reflect the light from the convex mirror as a wide diameter beam of light out of the flashlight through the lens.

A flashlight in accordance with another embodiment of the present application includes an LED light source, a lens positioned opposite the LED light source, a first mirrored portion formed in a center of the inner surface of the lens, wherein light from the LED light source is reflected off the first mirrored portion back in the direction of the LED light source and a concave mirror positioned opposite the first mirrored portion of the lens to reflect the light reflected by the first mirrored portion as a wide beam of light out of the flashlight through the lens.

A landscape flood light in accordance with an embodiment of the present application includes a low current drain high intensity LED light source providing a high intensity narrow beam of light, a lens positioned opposite the LED light source through which light exits the flood light, a convex mirror positioned in a center of the inside surface of the lens, wherein light from the LED light source is reflected off the convex mirror back in the direction of the LED light source and a concave mirror positioned opposite the convex mirror to reflect the light reflected by the convex mirror as a wide beam of light out of the flood light through the lens.

DETAIL DESCRIPTION OF INVENTION

LEDs are typically manufactured to emit light out of one end in substantially one direction. As a result, the light emitted from LEDs tends to be emitted in a relatively narrow beam. Thus, the normal flashlight lens commonly used for flashlights with incandescent bulbs, which in contrast emit lit in all directions, is not sufficient to expand the beam of light emitted by the LED into a wide diameter.

A flashlight in accordance with an embodiment of the present invention uses the larger mirror collecting capability of the Cassegrain configuration that traditionally concentrates a low intensity large field of light into a small diameter for viewing in reverse. That is, the high intensity light from a small LED is uniformly expanded to a larger diameter beam that is generally desirable for use with flashlights since the human eye needs only much lower intensity light to see, provided the light uniformly covers a larger area.

Further, in accordance with the present application, the Cassegrain configuration may be used to expand the beams of light from from LEDs in landscape flood lights for moonlight effects in trees. In this manner, the landscape flood lights enjoy the same advantages of low current drain and thus smaller wires and transformers can be used.

Specifically, a flashlight in accordance with an embodiment of the present application is described with reference to FIG. 1. FIG. 1 illustrates flashlight 1 in cross section. The flashlight 1 includes a high intensity LED 2 connected to the battery power source 3. While the power source illustrated in FIG. 1 is a battery power source, other power sources may be used is desired.

The light 4 from the LED is emitted in a forward direction as shown by ray lines to strike a small diameter convex shaped mirror surface 6 molded onto the inside surface of the flashlight lens 7 and silvered to provide high reflectivity. This silvered convex portion of the flashlight's otherwise clear lens reflects the light back onto a concave mirror 8 of a shape to receive the rays 9 coming back off of the convex shaped mirror 6 and reflecting the rays back forward out the main lens 7 of the flashlight. The shape of the convex mirror 6 and concave mirror 8 are designed (angle of incidence of the beam equaling the angle of reflection) to insure a very high quality, parallel ray beam of light with a larger diameter.

As can be seen in FIG. 1, when the narrow beam of light emitted from the LED reflects off the convex mirror, the individual rays are scattered in multiple directions and reflected back in the direction of the LED. The expanded rays of light are then collected by the concave mirror 8 and directed back forward out of the flashlight 1 through the lens 7 in a beam with a large diameter. Thus, a single narrow beam LED light source is used to provide a wide beam of light emitted from the flashlight. As a result, flashlight 1 has the benefit of longer life for the light source and batteries while still providing a beam of light that is sufficiently wide to provide good lighting for the user.

Figure 2:
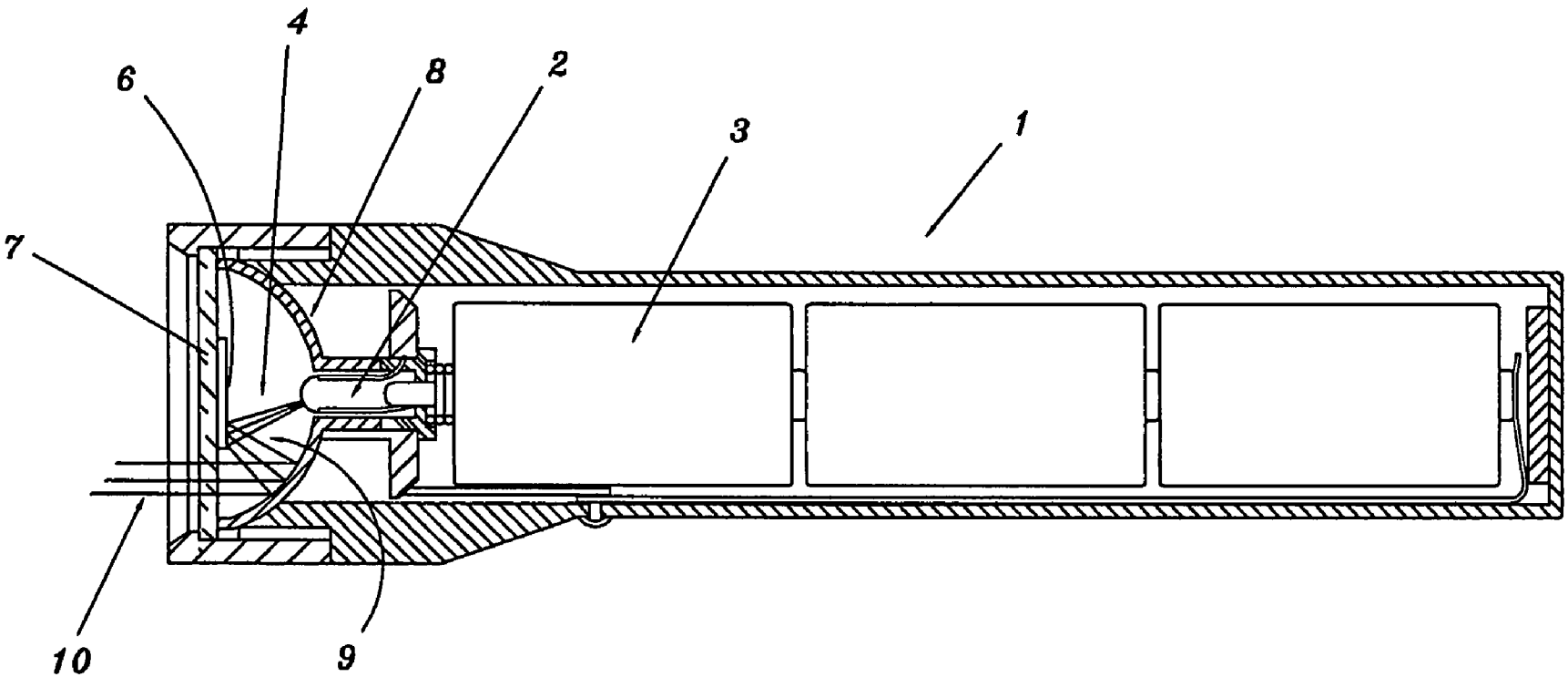
FIG. 2 shows a cross section of an LED flashlight using Cassegrain optics to expand the light output from a high intensity LED light source in accordance with another embodiment of the present application.

In an alternative embodiment, as illustrated in FIG. 2, the convex mirror 6 is replaced by a flat mirrored or silvered portion 6*a* on the inside surface of the flashlight lens 7. While the beam emitted by the LED is narrow, it does diverge slightly as it travels toward the mirrored section. The mirrored section is thus sized to reflect the diverging beam of light from the LED back onto the large concave mirror which collimates the beam and emits the light as a larger diameter illumination beam from the flashlight 1. The silvered spot may be designed to be partially transmissive to light to allow some of the LED light directly through the lens 7 to provide higher intensity in the center area of the flashlight beam.

Since the light emitted by the LED is substantially coherent, the expanded beam will be of a superior quality to those produced by today's normal incandescent bulb flashlights and the light source life and battery life will be greatly increased.

The flashlight 1 of the present application thus will provide a better quality beam, longer light source life, and lower battery drain since only a single LED is used rather than the multiple LEDs currently used for wide diameter multi-LED flashlights. Additionally, the flashlight is provided at a lower cost with increased battery life.

In another embodiment of the present invention, the Cassegrain optics can also be applied to landscape flood lights to provide a large coverage area with single or multiple LEDs while enjoying the same advantages as described above for flashlights. That is the light emitting portion of a conventional landscape floodlight is designed in a manner similar to the flashlight 1 of FIG. 1. One or more LED light sources are positioned opposite a lens. A convex mirror on the inner surface of the lens reflects the narrow beam(s) of light from the LED(s) back toward a concave mirror positioned around the LEDs which collects the reflected light and directs it as a wide diameter beam out of the lens. The landscape floodlight may use batteries as a power source, or may be powered via a transformer. The reduced current draw provided by the use of LEDs allows the size of the transformer and the size of the wires connected thereto to be smaller, thus saving cost.

The invention claimed is:

1. A flashlight comprising:

an LED light source;

a lens positioned opposite the LED light source;

a convex mirror positioned substantially in a center of the inner surface of the lens, wherein light from the LED light source is reflected off the convex mirror back toward the LED light source; and a concave mirror positioned opposite the convex mirror to reflect the light from the convex mirror as a wide diameter beam of light out of the flashlight through the lens.

2. The flashlight of claim 1, wherein the LED light source provides a narrow beam of high intensity light in substantially one direction.

3. The flashlight of claim 1, wherein the convex mirror is designed such that the light from the LED light source is reflected off of the convex mirror back toward the LED light source in a range of angles.

4. The flashlight of claim 3, wherein the concave mirror is positioned such that it surrounds the LED light source and is larger than the convex mirror so that the light reflected off the convex mirror is collected and directed out of the flashlight in a wide beam of light.

5. A flashlight comprising:

an LED light source;

a lens positioned opposite the LED light source;

a first mirrored portion formed in a center of the inner surface of the lens, wherein light from the LED light source is reflected off the first mirrored portion back in the direction of the LED light source; and a concave mirror positioned opposite the first mirrored portion of the lens to reflect the light reflected by the first mirrored portion as a wide beam of light out of the flashlight through the lens.

6. The flashlight of claim 5, wherein the LED light source provides a narrow beam of high intensity light in substantially one direction.

7. The flashlight of claim 5, wherein the mirrored first portion of the lens reflects the light from the LED light source back in the direction of the LED light source in a wider beam than the narrow beam of the LED light source.

8. The flashlight of claim 7, wherein the concave mirror is positioned such that it surrounds the LED light source and is larger than the first mirrored portion of the lens such that the light reflected off the mirrored first portion of the lens is collected and directed out of the flashlight as a wide beam of light.

9. The flashlight of claim 8, wherein the first mirrored portion of the lens allows some light from the LED light source to pass through it without reflection, such that the wide beam of light passing out of the flashlight lens includes a portion of high intensity light.

10. A landscape flood light comprising:

a low current drain high intensity LED light source providing a high intensity narrow beam of light;

a lens positioned opposite the LED light source through which light exits the flood light;

a first mirrored portion formed in a center of the inside surface of the lens, wherein light from the LED light source is reflected off the first mirrored portion back in the direction of the LED light source; and a concave mirror positioned opposite the convex mirror to reflect the light reflected by the convex mirror as a wide beam of light out of the flood light through the lens.

11. The flood light of claim 10, wherein the LED light source provides a narrow beam of high intensity light in substantially one direction.

12. The flood light of claim 10, wherein the convex mirror is designed such that the light from the LED light source is reflected off of the convex mirror back toward the LED light source in a range of angles.

13. The flood light of claim 10, wherein the concave mirror is positioned such that it surrounds the LED light source and is larger than the convex mirror so that the light reflected off the convex mirror is collected and directed out of the flashlight in a wide beam of light.

14. The flood light of claim 10, wherein the first mirrored portion of the lens is a convex mirror positioned on the inside surface of the lens to reflect light back toward the LED light source.

* * * * *